US007901176B2

(12) United States Patent
Minakawa

(10) Patent No.: US 7,901,176 B2
(45) Date of Patent: Mar. 8, 2011

(54) SHEET SUPPLY/CONVEY SUPPORTING DEVICE

(75) Inventor: Yoshihisa Minakawa, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 302 days.

(21) Appl. No.: 12/219,466

(22) Filed: Jul. 23, 2008

(65) Prior Publication Data

US 2009/0026688 A1 Jan. 29, 2009

(30) Foreign Application Priority Data

Jul. 27, 2007 (JP) ..... 2007-196033

(51) Int. Cl.
*B65H 31/34* (2006.01)
*B65G 59/00* (2006.01)

(52) U.S. Cl. ..... 414/789; 414/795.8; 414/789.7; 414/396; 414/458

(58) Field of Classification Search ..... 271/13, 271/220–221, 3.02, 9.01; 414/304, 623, 414/664, 785, 788.9, 789, 789.1, 789.7, 789.9, 414/790.5, 790.7, 790.8, 791.6, 794.2, 795.7, 414/795.8, 816, 907
See application file for complete search history.

(56) References Cited

U.S. PATENT DOCUMENTS

| | | | | |
|---|---|---|---|---|
| 3,149,732 | A * | 9/1964 | Gagnon et al. | 414/793.8 |
| 3,439,605 | A * | 4/1969 | Hanley | 100/7 |
| 4,805,379 | A * | 2/1989 | Leibetseder et al. | 53/444 |
| 4,828,448 | A * | 5/1989 | Skeath | 414/304 |
| 5,868,549 | A * | 2/1999 | Lee et al. | 414/791.6 |
| 6,536,645 | B2 | 3/2003 | Minakawa | |
| 6,631,867 | B2 | 10/2003 | Minakawa | |

FOREIGN PATENT DOCUMENTS

| | | | |
|---|---|---|---|
| FR | 2573401 | A * | 5/1986 |
| JP | 61-012538 | | 1/1986 |
| JP | 05270513 | A * | 10/1993 |
| JP | 10-035966 | | 2/1998 |
| JP | 2002-240996 | | 8/2002 |

* cited by examiner

*Primary Examiner* — Gregory W Adams
(74) *Attorney, Agent, or Firm* — Harness, Dickey & Pierce, PLC

(57) ABSTRACT

In a sheet supply/convey supporting device, a sheet placing unit includes a pair of guide members and a supporting plate that form a space for holding a sheet stack, and a carriage member supports the sheet placing unit and includes a driving mechanism for lifting or lowering the sheet placing unit. The supporting plate supports the sheet stack and is movable between an opened position at which a bottom of the space is opened and a closed position at which the bottom of the space is closed.

7 Claims, 13 Drawing Sheets

SHEET SUPPLY/CONVEY SUPPORTING DEVICE

CROSS-REFERENCE TO RELATED APPLICATIONS

The present application claims priority to and incorporates by reference the entire contents of Japanese priority document 2007-196033 filed in Japan on Jul. 27, 2007.

BACKGROUND OF THE INVENTION

1. Field of the Invention

The present invention relates to a sheet supply/convey supporting device.

2. Description of the Related Art

When sheets are supplied to an image forming apparatus such as a copier, a printer, and a facsimile, a carriage is used to convey the sheets from a sheet storing area to the image forming apparatus. However, currently, a user (an operator) has to supply the sheets by hand from the carriage to a cassette or a tray of the image forming apparatus.

The act of supplying sheets places a burden on the user because the user bends his/her knees or bows to supply the sheets to the cassette or the tray, so that it is a hard work for, particularly, women or elderly people. Furthermore, the larger and larger number of sheets is recently supplied to a high-speed image forming apparatus and the act of supplying the sheets increases in frequency. Consequently, the user has been more burdened with supplying sheets.

Therefore, various apparatuses and methods to reduce such a burden of supplying sheets to an image forming apparatus or a printing machine have been proposed.

Japanese Patent Application Laid-open No. 2002-240996 discloses a roll-sheet-supply supporting device that includes a roll-sheet holding mechanism for holding a roll of sheet, an up-and-down mechanism for moving the roll-sheet holding mechanism up and down, and a conveying mechanism for conveying the roll-sheet holding mechanism and the up-and-down mechanism.

Japanese Patent Application Laid-open No. S61-12538 discloses a sheet loading method. According to the method, a sheet loading plate is placed on crossbars attached to a carriage, a stack of sheets is placed on the sheet loading plate, the carriage is moved to a feeding unit of a printing machine, the sheet loading plate on which the sheets are stacked is lifted by an elevating bar of the printing machine, and the sheets are positioned to a predetermined position for sheets to be supplied.

However, the roll-sheet-supply supporting device disclosed in Japanese Patent Application Laid-open No. 2002-240996 serves to assist supplying a roll of sheet and does not serve to supply sheets to a common image forming apparatus in which cut sheets, that is, a stack of sheets is used. The sheet loading method disclosed in Japanese Patent Application Laid-open No. S61-12538 requires a dedicated configuration on a side of an image forming apparatus such as an elevating bar and cannot be supported by a general apparatus.

SUMMARY OF THE INVENTION

It is an object of the present invention to at least partially solve the problems in the conventional technology.

According to an aspect of the present invention, there is provided a sheet supply/convey supporting device used for supplying a sheet stack to a sheet accommodating unit, the sheet supply/convey supporting device including a sheet placing unit that includes a pair of guide members and a supporting plate and that includes a space for holding a sheet stack, the guide members defining both sides of the space, and the supporting plate defining a bottom of the space to support the sheet stack and being movable between an opened position at which the bottom is opened and a closed position at which the bottom is closed; and a carriage member that supports the sheet placing unit and includes a driving mechanism for lifting or lowering the sheet placing unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
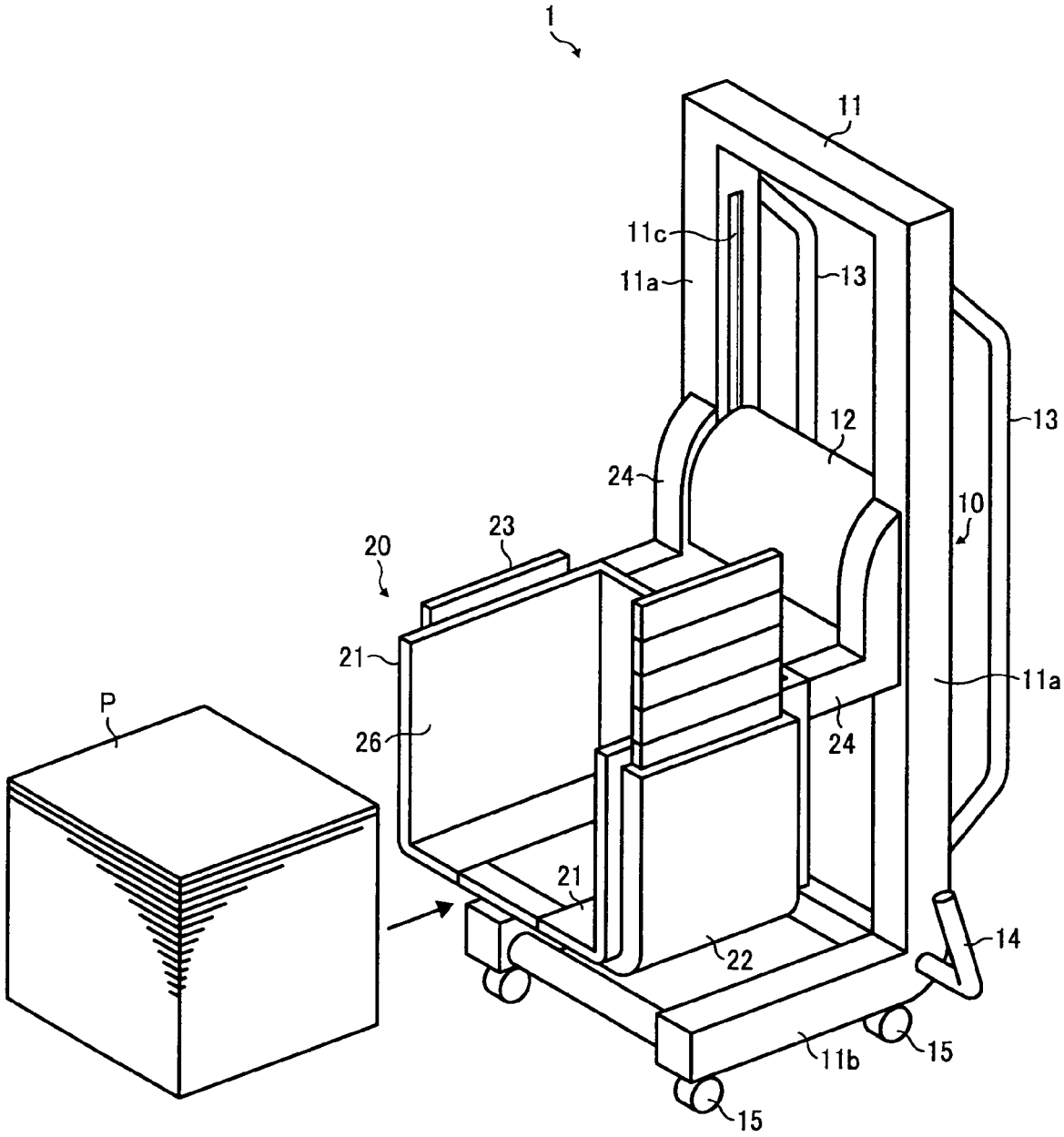
FIG. 1 is a perspective view of a sheet supply/convey supporting device as an example according to an embodiment of the present invention.
Figure 2C:
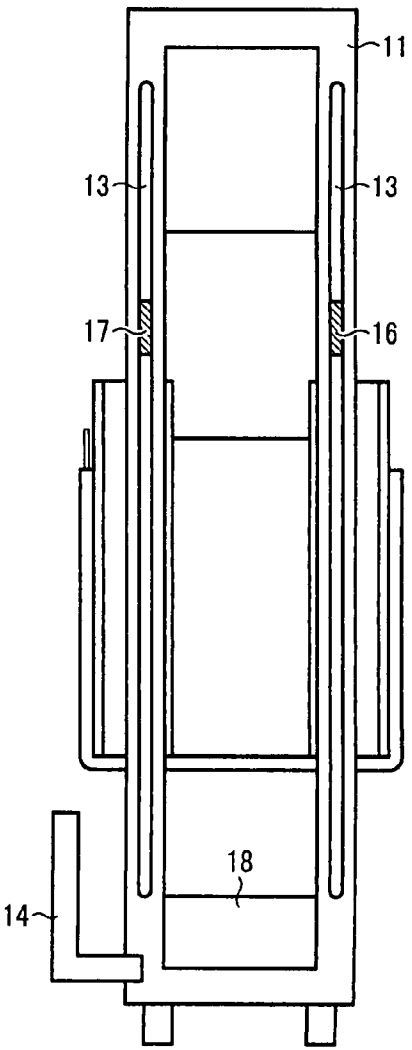
FIGS. 2A, 2B, and 2C are a front view, a side view, and a rear view of the sheet supply/convey supporting device, respectively.
Figure 2B:
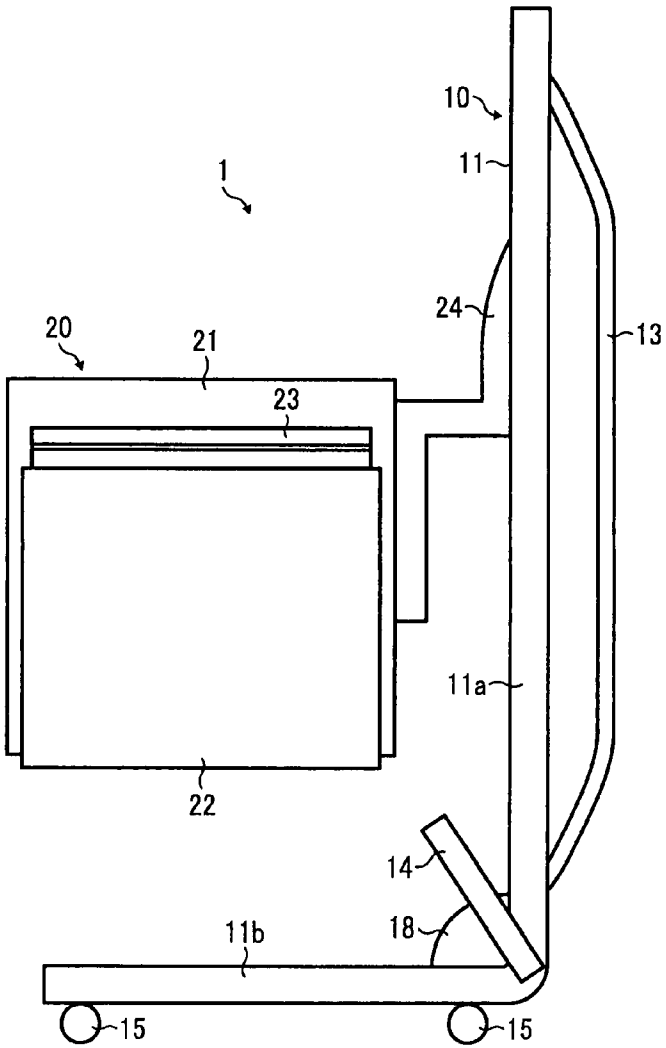
Figure 2A:
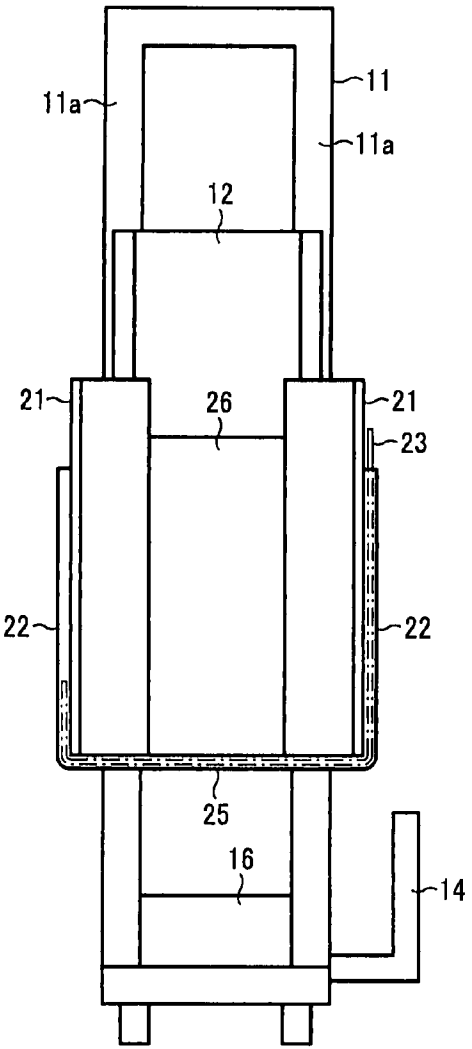

FIG. 1 is a perspective view of a sheet supply/convey supporting device 1 that includes a carriage 10 and a sheet placing unit 20 as an example according to an embodiment of the present invention. FIGS. 2A to 2C are a front view, a side view, and a rear view of the sheet supply/convey supporting device 1, respectively.

The carriage 10 includes a mainframe 11. The mainframe 11 includes longitudinal beams 11*a* and lateral beams 11*b*, and has an L-shape when viewed from the side. A driving unit 12 is arranged between the longitudinal beams 11*a*. A handle 13 is attached to a rear surface of each of the longitudinal beams 11*a*. Two casters 15 are attached below each of the lateral beams 11*b*. A battery 18 is arranged at a joint of the longitudinal beams 11*a* and the lateral beams 11*b*. A guide bar (a positioning unit) 14 that has an L-shape when viewed from the front side is attached to one side of the joint to project from an outer surface of the mainframe 11.

Figure 3:
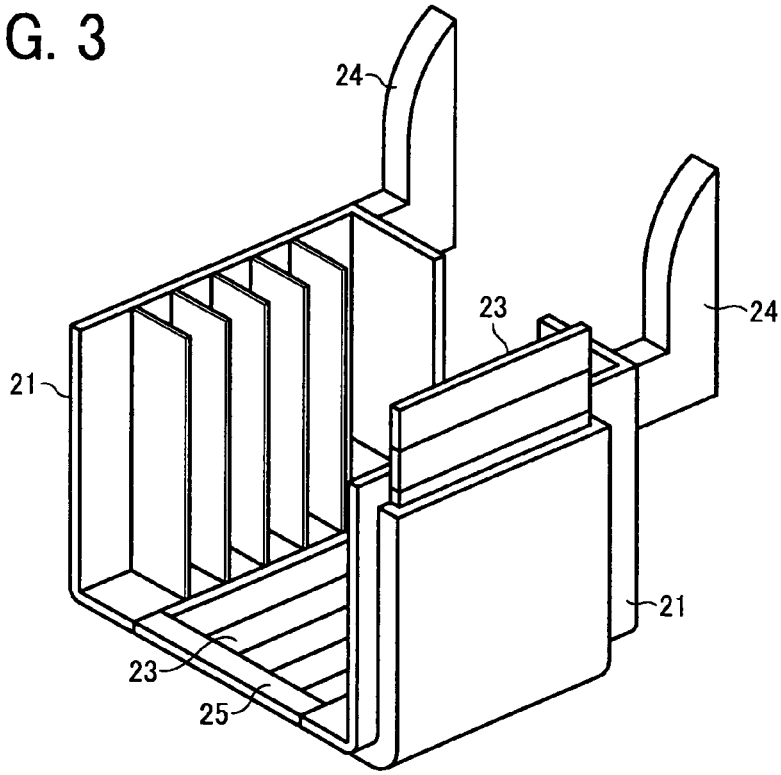
FIG. 3 is a perspective view of a sheet placing unit shown in FIG. 1.
Figure 4:
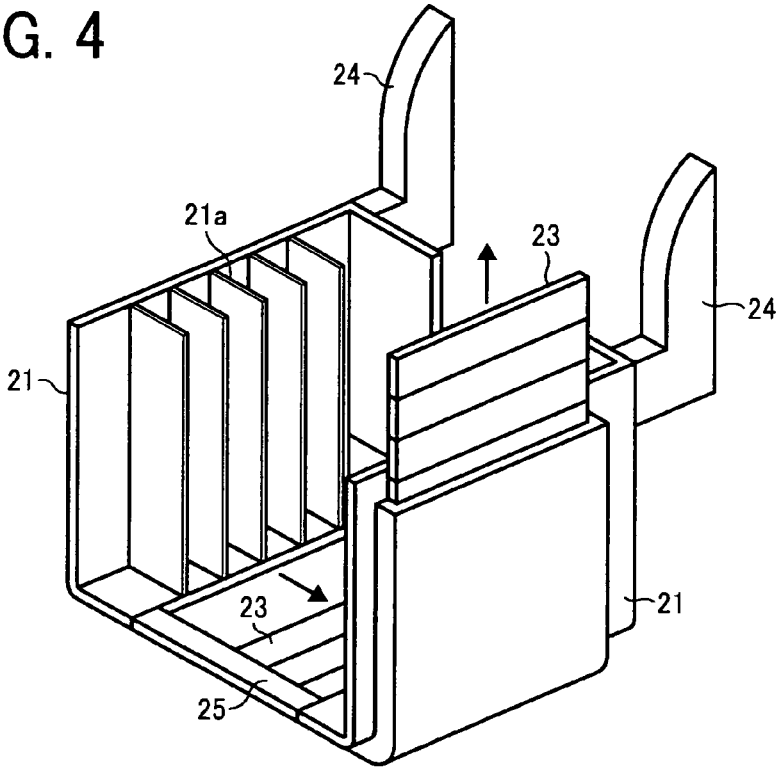
FIG. 4 is a perspective view for explaining a state in which a supporting plate shown in FIG. 1 is moved.

The sheet placing unit 20 includes a pair of right and left guiding plates 21 (guiding members) arranged opposed to each other, and a sheet holding space 26 is formed between the guiding plates 21. Each of the guiding plates 21 is attached to and supported by the driving unit 12 of the carriage 10 through supporting arms 24. The sheet placing unit 20 is supported above the lateral beams 11*b* in front of the longitudinal beams 11*a* and can be lifted or lowered along the longitudinal beams 11*a*. Supporting-plate holding units 22 are provided to the guiding plates 21 to form a holding space in which a bendable supporting plate 23 is contained and held in a slidably movable manner along outer surfaces (side surfaces and a bottom surface) of the guiding plates 21. As shown in FIGS. 3 and 4, the guiding plates 21 are arranged with a space therebetween and are coupled by coupling guides (guide rails) 25 arranged on the front and back sides between the guiding plates 21. The coupling guide 25 on the back side (on the side of the longitudinal beam 11*a*) is not shown in FIGS. 3 and 4.

As described above, the supporting plate 23 can slidably move inside the holding space formed by the supporting-plate holding units 22 and the guiding plates 21. As shown in FIGS. 2A and 3, when the supporting plate 23 is arranged over the right and left guiding plates 21, the supporting plate 23 covers a bottom of the sheet holding space 26 between the guiding plates 21, so that sheets P can be placed in the sheet holding space 26. As shown in FIG. 4, when one end of the supporting plate 23 on the side of one guiding plate 21 is held and pulled up in a direction indicated by an arrow and the other end of the supporting plate 23 comes off the other guiding plate 21, the bottom of the sheet holding space 26 is opened. As the supporting plate 23 is pulled up, the opening is gradually increased. When the other end of the supporting plate 23 is accommodated in the one guiding plate 21, an area surrounded by the guiding plates 21 and the coupling guides 25, that is, the bottom of the sheet holding space 26 is fully opened. When fully opening the bottom of the sheet holding space 26, it is not necessary to pull up the whole supporting plate 23 from the one guiding plate 21. Furthermore, the supporting plate 23 can be pulled up from any one of the guiding plates 21 to open the bottom of the sheet holding space 26. As shown in FIGS. 3 and 4, a plurality of ribs 21*a* is provided to inner surfaces of the guiding plates 21, each of which extends in an up-and-down direction.

Figure 5A:
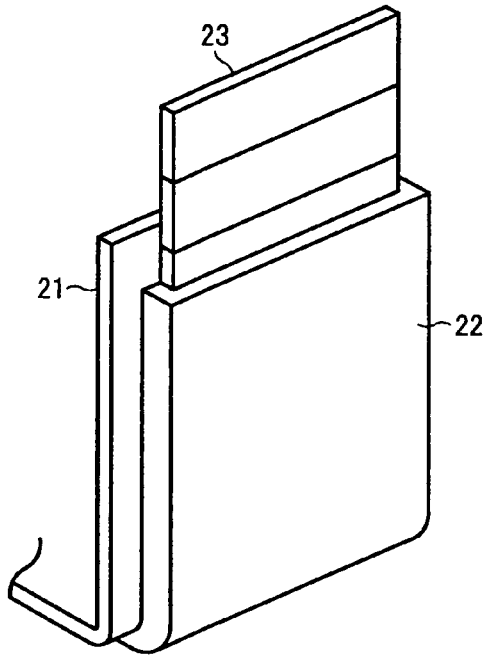
FIGS. 5A and 5B are perspective views partially illustrating a guiding plate and the supporting plate shown in FIG. 1, respectively.
Figure 5B:
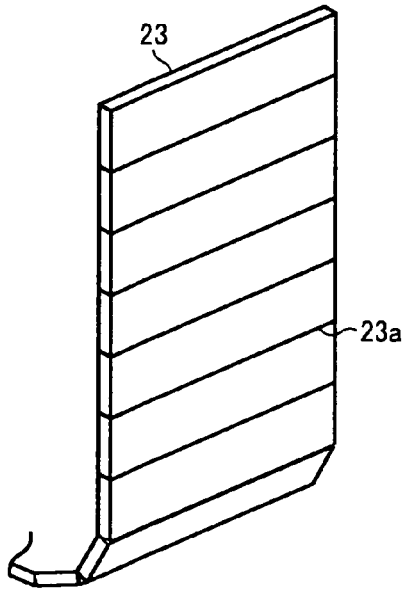

FIGS. 5A and 5B are perspective views partially illustrating the guiding plate 21 and the supporting plate 23, in which only the supporting plate 23 is partially illustrated in FIG. 5B. The supporting plate 23 is made of, for example, polycarbonate-acrylonitrile butadiene styrene (PC-ABS (PC/ABS)) resin. As shown in FIG. 5B, a plurality of grooves 23*a* is formed in the supporting plate 23 in a lateral direction, so that the supporting plate 23 can be bent. In the embodiment, the supporting plate 23 is manually moved by a user. However, as shown in FIG. 6, the supporting plate 23 can be moved by a driving unit, which results in improved workability.

Figure 6:
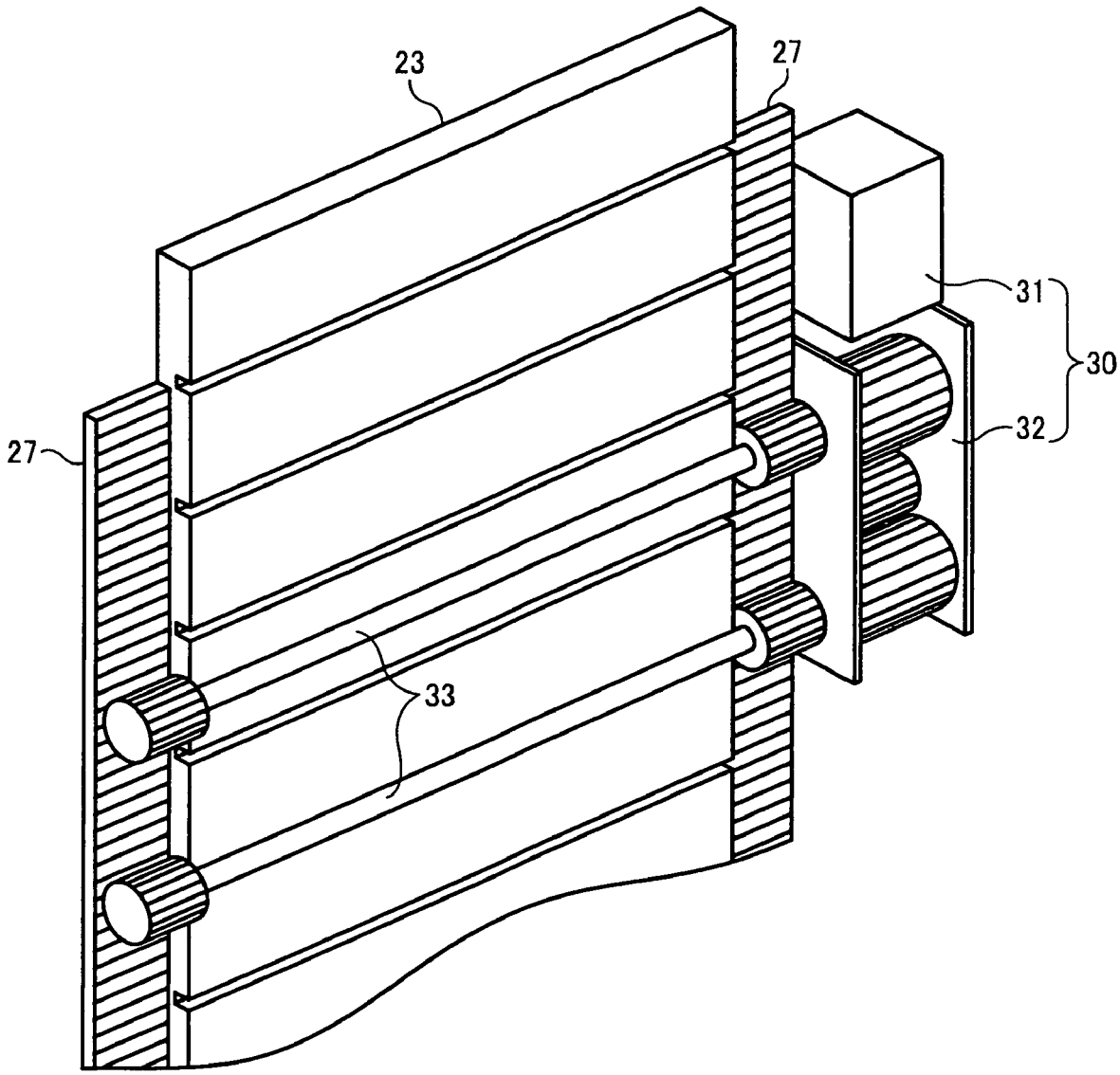
FIG. 6 is a schematic diagram of a driving mechanism of the supporting plate.

Specifically, as shown in FIG. 6, racks 27 are integrally formed on both sides of the supporting plate 23. A driving unit 30 is attached to one of the guiding plates 21 positioned on the back side. The driving unit 30 includes a motor 31 serving as a driving source, a gear train 32, two rollers 33 with gears, and a control unit (not shown). The rollers 33 are rotatably held by the supporting-plate holding unit 22 (see, FIGS. 1 and 2) to engage with the racks 27. This configuration enables the supporting plate 23 to be lifted or lowered through the motor 31, thereby opening or closing the bottom of the sheet holding space 26. 66-nylon resin is used for the supporting plate 23 to slide the supporting plate 23 easily. Thus, it is easy to move the supporting plate 23 irrespective of the weight of stacked sheets.

Figure 7A:
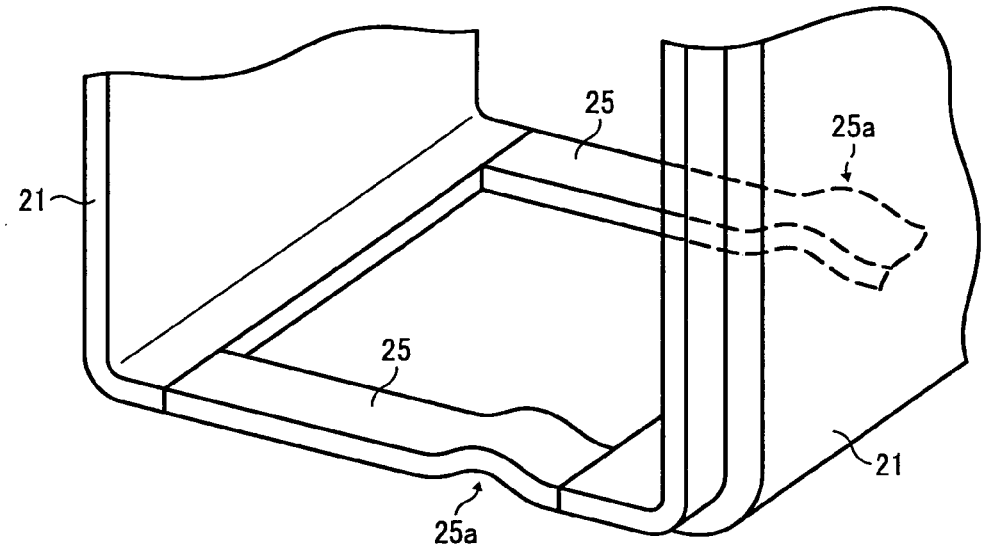
FIGS. 7A and 7B are schematic diagrams of a curved portion of coupling guides shown in FIG. 3.
Figure 7B:
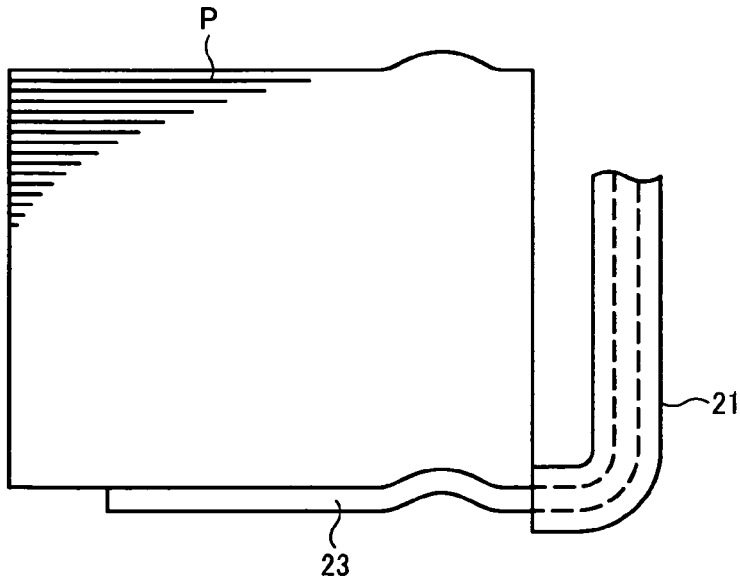

As shown in FIGS. 7A and 7B, each coupling guide 25 is provided with a curved portion 25*a* near one of the guiding plates 21. Therefore, when the supporting plate 23 is pulled in along one of the guiding plates 21, the supporting plate 23 is curved like a bow, which prevents a sheet from being pulled (involved) into the guiding plate 21.

As described above, the sheet placing unit 20 can be lifted or lowered along the longitudinal beams 11*a*. An up-and-down mechanism for moving the sheet placing unit 20 up and down is explained as an example.

A motor (not shown) serving as a driving source is accommodated in the driving unit 12. A rotation shaft (not shown) driven with rotation of the motor is arranged to project from both sides of the driving unit 12 in a width direction (a right-and-left direction in FIG. 2A). A gear (not shown) is attached to each end of the rotation shaft. A rack (not shown) is arranged in and along each longitudinal beam 11*a*, and slits 11*c* shown in FIG. 1 are formed in inner sides (surfaces on which the longitudinal beams 11*a* are opposed to each other) of the longitudinal beams 11*a*. The rotation shaft is arranged to insert from the slits 11*c* into the longitudinal beams 11*a*. The gears arranged on the ends of the rotation shaft are engaged with the racks of the longitudinal beams 11*a*. This configuration enables the sheet placing unit 20 to be lifted or lowered to a predetermined position by controlling the rotation of the motor of the driving unit 12.

As shown in FIG. 2C, a switch 16 for controlling up-and-down movement of the sheet placing unit 20 is provided on the back side of the right-side longitudinal beam 11*a*. The switch 16 is a slide switch to enable a one-handed operation. Moreover, as shown in FIG. 2C, a switch 17 is provided on the back side of the left-side longitudinal beam 11*a*. The switch 17 controls the motor of the driving unit 30 for moving the supporting plate 23 shown in FIG. 6. The switch 17 is also a slide switch to enable a one-handed operation. In the embodiment, the sheet placing unit 20 is lifted and lowered by sliding the switch 16 up and down, and the supporting plate 23 is moved up and down by sliding the switch 17 up and down. Moving the supporting plate 23 up and down means moving it up and down with respect to one of the guiding plates 21 (the guiding plate 21 by which the supporting plate 23 is supported when the bottom of the sheet holding space 26 is opened). The motors of both the driving unit 12 and the driving unit 30 are driven by electric power from the battery 18 shown in FIGS. 2B and 2C. The battery 18 can be charged.

The positions of the switches 16 and 17 can be adjusted on the longitudinal beams 11*a* in an up-and-down direction, so that a user can change the positions of the switches 16 and 17 depending on the height of the user considering ease of use, whereby their usability is improved.

As described above, the guiding plates 21 are attached to and supported by the driving unit 12 through the supporting arms 24. The guiding plates 21 are supported by the supporting arms 24 in such a manner that the guiding plates 21 can move in a right-and-left direction in FIG. 2A. Thus, as shown in FIG. 8, the guiding plates 21 can be moved away from or close to each other.

Next, an operation of supplying sheets by the sheet supply/convey supporting device 1 that has the above configuration is explained.

Figure 8:
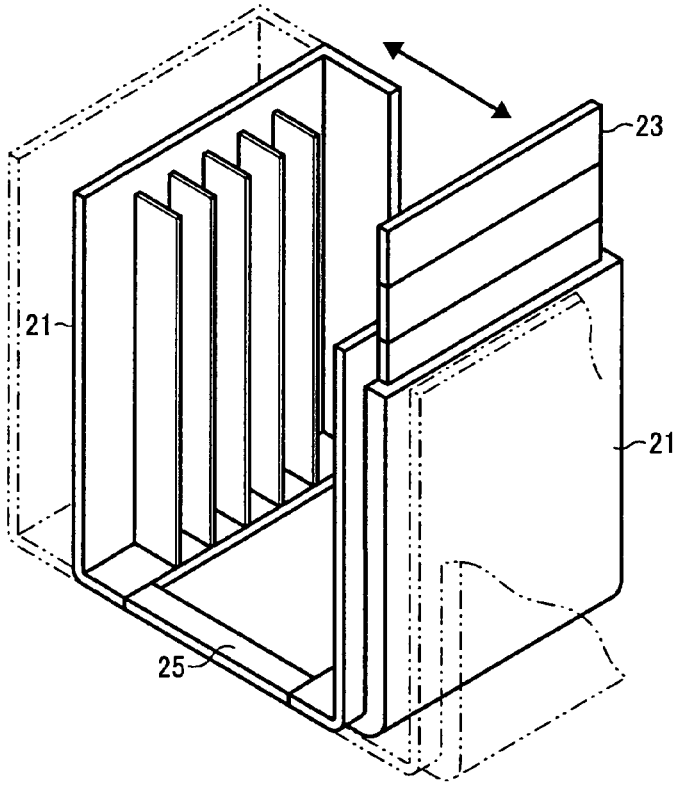
FIG. 8 is a schematic diagram for explaining a state in which a distance between a pair of guiding plates is adjusted.

First, as shown in FIG. 8, the guiding plates 21 are moved away from or close to each other to fit a width of stacked sheets. The supporting plate 23 is positioned to close the bottom of the sheet holding space 26. If the bottom of the sheet holding space 26 is opened, the supporting plate 23 is moved to close the bottom.

Figure 9:
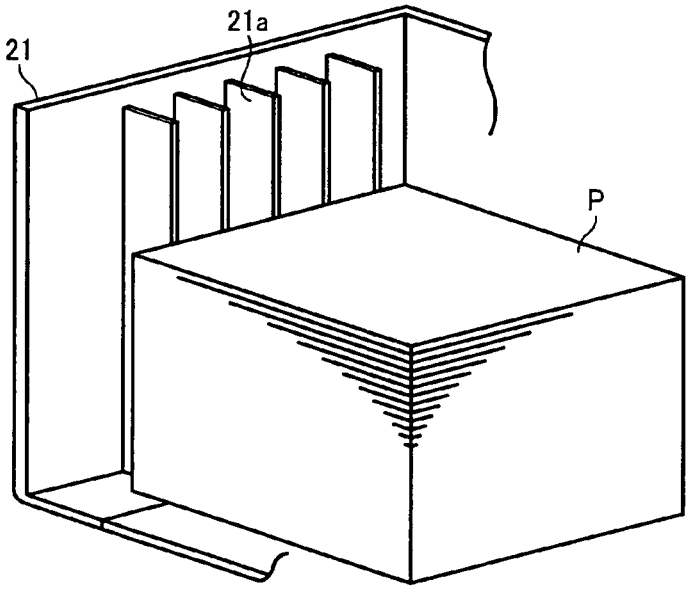
FIG. 9 is a schematic diagram for explaining a state in which sheets are placed on the sheet placing unit.

As shown in FIG. 1, the sheet stack P is placed on the supporting plate 23 between the guiding plates 21 (the sheet stack P is held in the sheet holding space 26). Then, as shown in FIG. 9, both sides of the sheet stack P are caught and guided by the ribs 21*a* provided to the guiding plates 21. The ribs 21*a* enable a reliable guidance of the sides of the sheet stack P and reduction in friction with the sheet stack P when placing the sheet stack P.

The sheet supply/convey supporting device 1 that carries the sheet stack P is moved to a position of an image forming apparatus 100 at which the sheet stack P is to be supplied. It is preferable in view of stability that the sheet placing unit 20 is lowered in moving the sheet supply/convey supporting device 1 as shown in FIG. 1.

Figure 10:
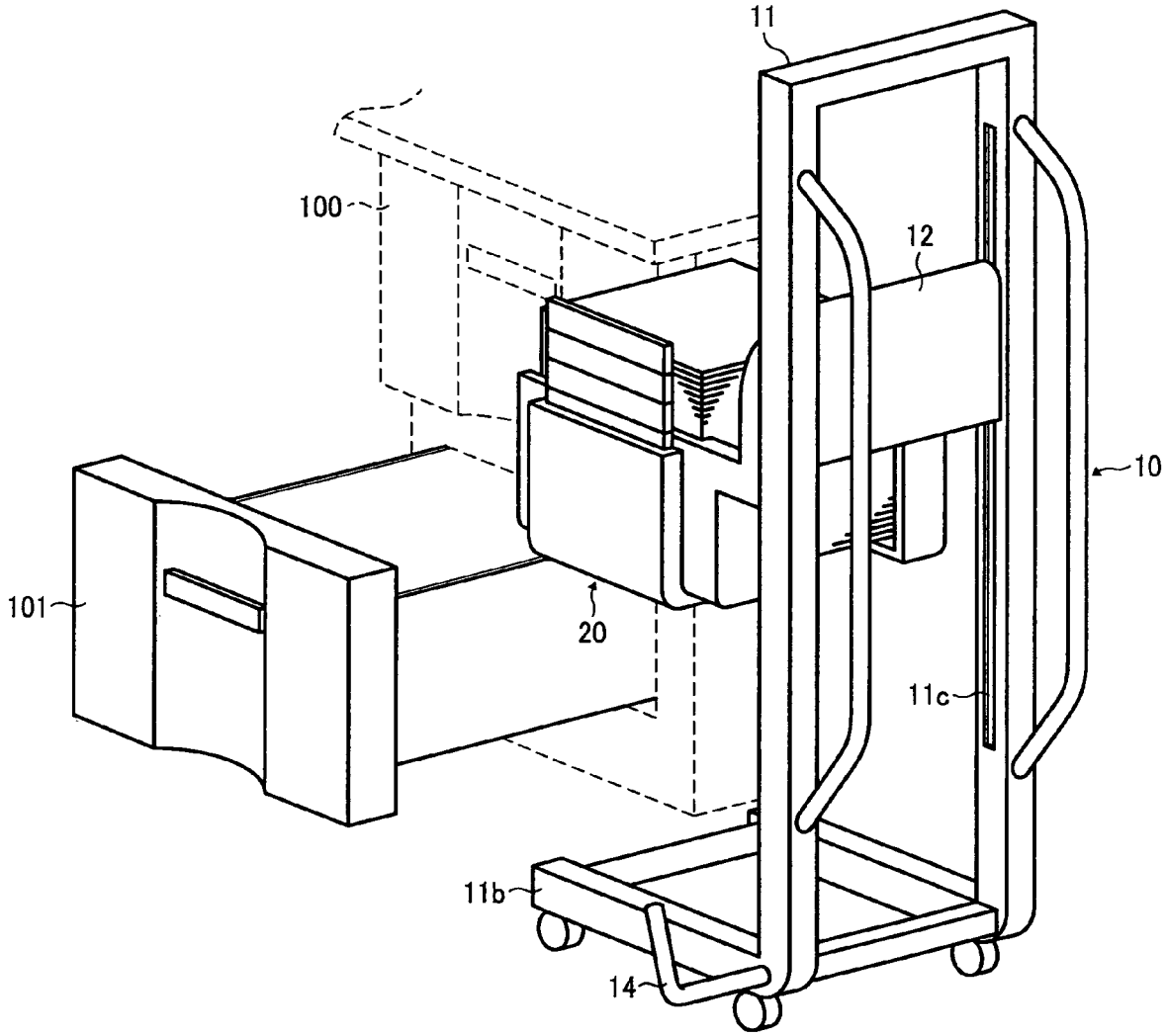
FIG. 10 is a perspective view for explaining a sheet supplying operation.
Figure 11:
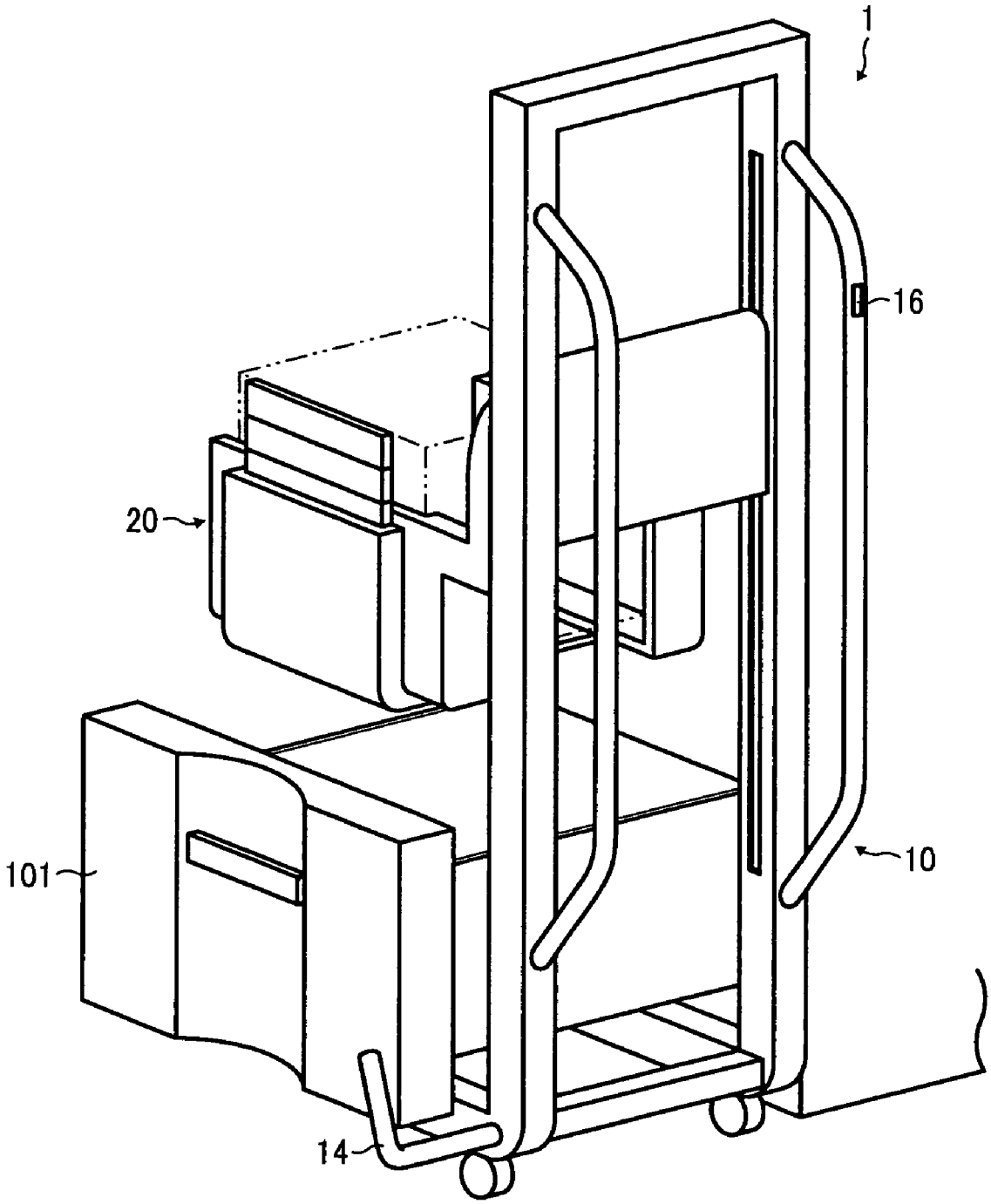
FIG. 11 is a perspective view for explaining a carriage positioning operation.

As shown in FIG. 10, a feeding tray 101 of the image forming apparatus 100 is pulled out, and the sheet placing unit 20 is lifted (in a case in which the sheet placing unit 20 is lowered) to arrange it to a higher position than the feeding tray 101. The lateral beams 11*b* are then inserted under the feeding tray 101 to position the sheet placing unit 20 over the feeding tray 101. At that time, to precisely position the sheet placing unit 20, the carriage 10 is positioned by applying the guide bar 14 on the carriage 10 to a front surface of the feeding tray 101 as shown in FIG. 11. A stop lever (not shown) is provided to the casters 15, so that the sheet supply/convey supporting device 1 does not move when the stop lever is operated.

Figure 12:
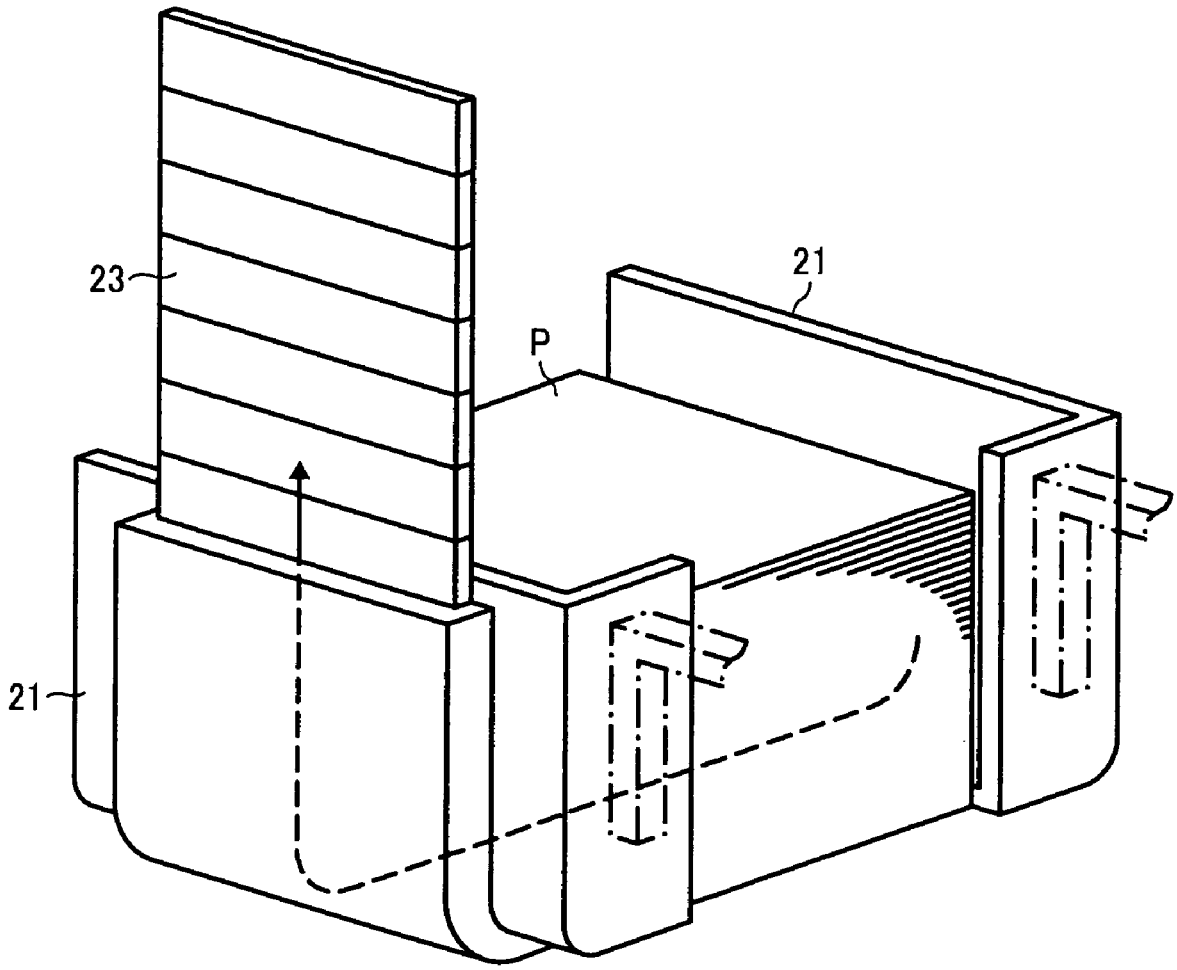
FIG. 12 is a schematic diagram for explaining a state in which the supporting plate is moved to supply sheets.

Next, the guiding plates 21 are moved apart from each other to have a larger space therebetween than a width of a sheet. Thus, the sheet stack P is held on the supporting plate 23 between the guiding plates 21. The switch 16 is operated, so that the sheet placing unit 20 is lowered to a position at which sheets are placed in the feeding tray 101. Furthermore, as shown in FIG. 12, the supporting plate 23 is pulled up by operating the switch 17 (or by hand) (with respect to one of the guiding plates 21) to open the bottom of the sheet holding space 26. When the bottom of the sheet holding space 26 is opened by moving the supporting plate 23, the sheet stack P is supplied to the feeding tray 101.

Figure 13:
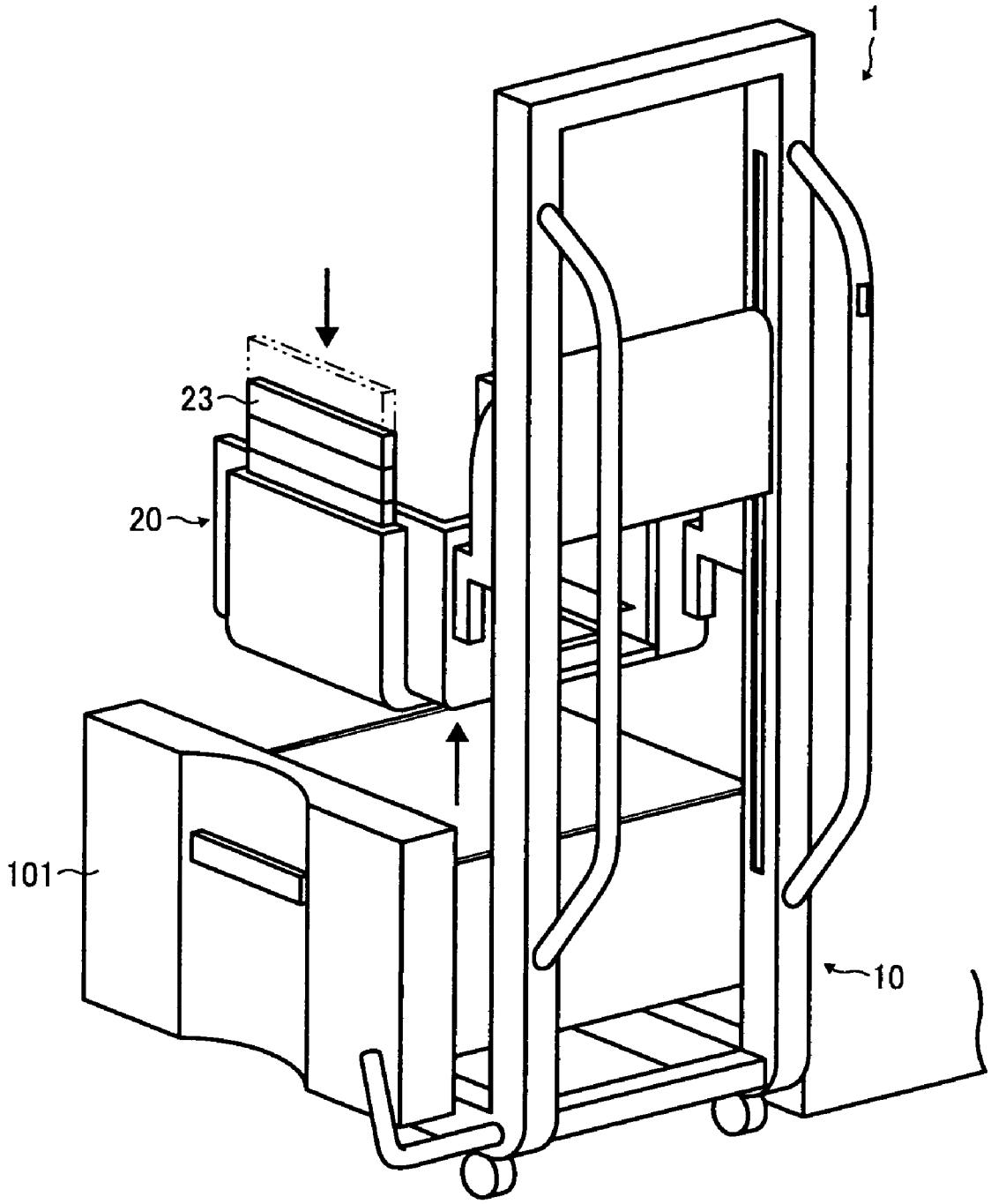
FIG. 13 is a perspective view for explaining a state in which the sheet placing unit is lifted after sheets are supplied.

The sheet placing unit 20 is then lifted from the feeding tray 101 as shown in FIG. 13. The bottom of the sheet holding space 26 can be closed by lowering the supporting plate 23 to prepare for the next sheet stack. Thus, supplying sheets has completed, so that the sheet supply/convey supporting device 1 is moved away from the image forming apparatus 100.

If the supporting plate 23 is moved by the driving unit 30 as shown in FIG. 6, the supporting plate 23 can be automatically lowered to close the bottom of the sheet holding space 26 after sheets are supplied and the sheet placing unit 20 is lifted. Specifically, the supporting plate 23 can be moved (the bottom of the sheet holding space 26 can be closed) a predetermined time after sheets are supplied and the sheet placing unit 20 is lifted. Alternatively, it is preferable that timing at which the supporting plate 23 is automatically lowered can be adjusted (the bottom of the sheet holding space 26 is closed).

The sheet supply/convey supporting device 1 according to the embodiment can assist supplying sheets to a sheet cassette or a sheet tray with a common configuration in an ordinary image forming apparatus, thereby reducing efforts of supplying sheets. Even women or elderly people can easily and reliably supply sheets because it is unnecessary to manually lift or convey a heavy sheet stack. Moreover, a large number of sheets can be supplied at a time whereby it is possible to reduce a frequency of operations.

The guiding plates 21 guide both sides of sheets, so that the sheets are not scattered during their conveyance. Furthermore, it is possible to prevent sheets from falling down because the supporting plate 23 holds the sheets from the bottom.

If the supporting plate 23 is moved by the driving unit 30, the supporting plate 23 can be moved even if a large stack of sheets is placed thereon, enabling to reliably supply the sheets.

The ribs 21*a* provided to the inner sides of the guiding plates 21 come into contact with sides of sheets, so that static electricity between sheets is removed, so that it is possible to prevent sheets from sticking together or from being improperly supplied.

The handles 13 are formed to be vertically long, so that the sheet supply/convey supporting device 1 can be operated by an operator irrespective of the height of the operator.

The sheet supply/convey supporting device 1 can be also used, in addition to supplying unused sheets, to take out and convey printed sheets discharged to a discharging tray. Next, an operation of taking out and conveying printed sheets is explained.

Figure 14:
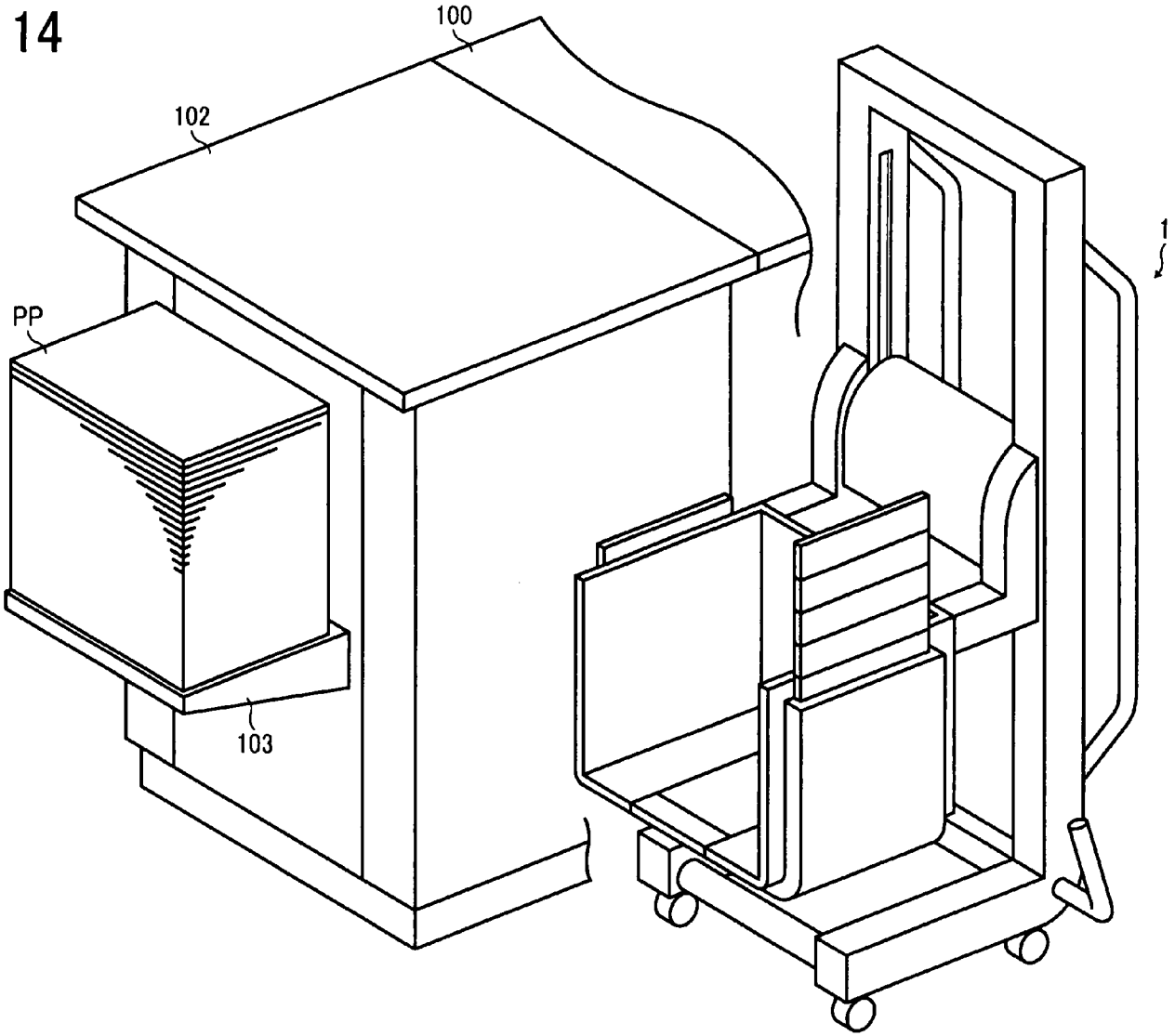
FIG. 14 is a perspective view for explaining a case in which printed material on which an image is formed is conveyed.

As shown in FIG. 14, a stack of output sheets (printed sheets) PP is stacked on a discharging tray 103 provided to a side of a discharging device 102 of the image forming apparatus 100. The sheet supply/convey supporting device 1 can be used to take out and convey the large number of printed sheets PP.

Figure 15:
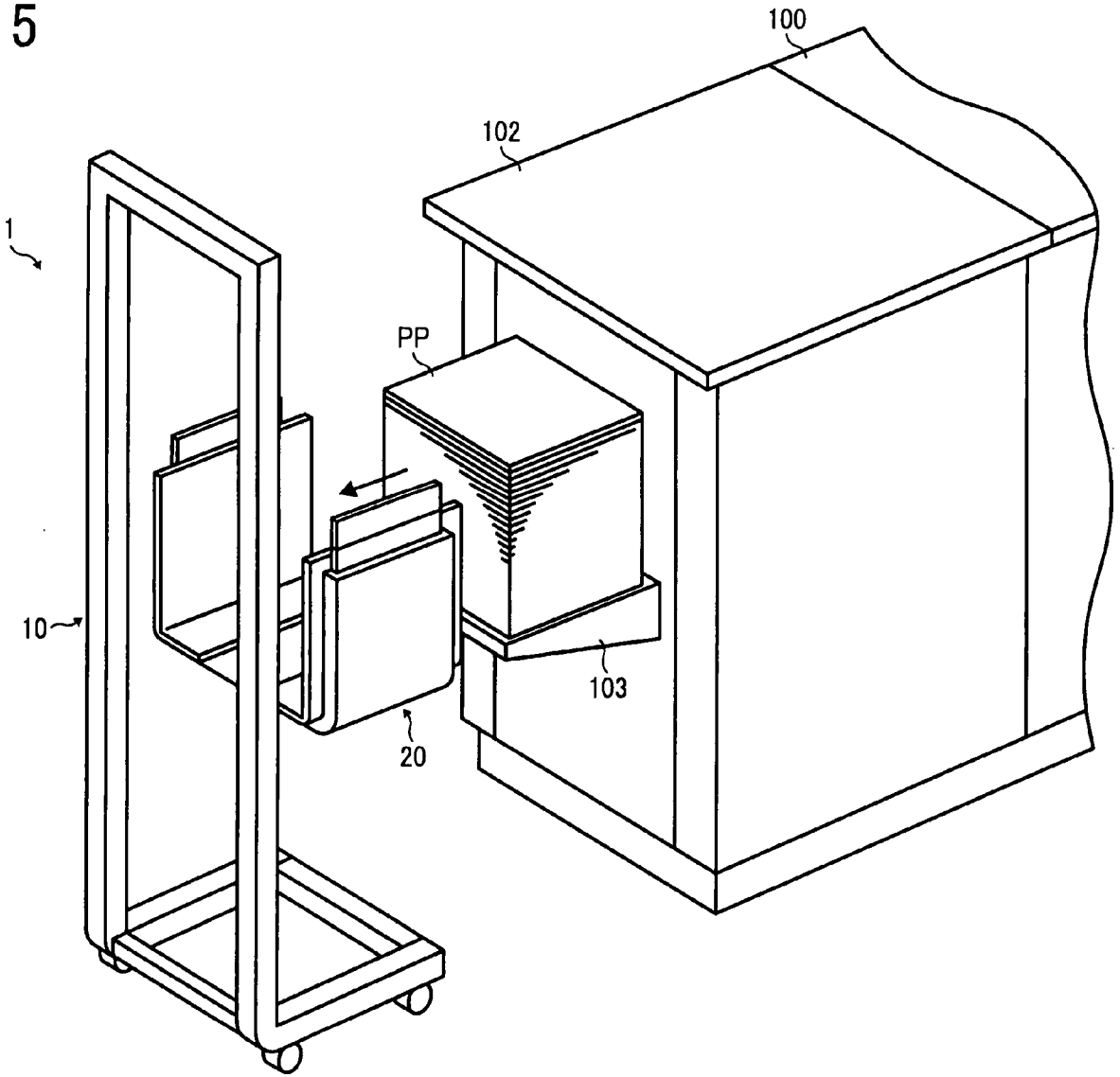
FIG. 15 is a perspective view for explaining a state in which printed material is moved from a discharging tray to the sheet placing unit.

As shown in FIG. 15, the sheet supply/convey supporting device 1 is moved to the side of the discharging device 102 to oppose the discharging tray 103. The sheet placing unit 20 is moved to a position corresponding to the discharging tray 103 by operating the switch 16. The carriage 10 is moved to bring an edge of the sheet placing unit 20 into contact with the discharging tray 103, so that the discharging tray 103 and the sheet placing unit 20 are arranged consecutively. The stop lever for the casters 15 is operated to stop moving the sheet supply/convey supporting device 1. Then, the printed sheets PP stacked on the discharging tray 103 are slid and moved onto the supporting plate 23. Thereafter, the sheet supply/convey supporting device 1 is moved to a desired position. After the sheet placing unit 20 is lowered or lifted, the supporting plate 23 is moved to open the bottom of the sheet holding space 26, so that the printed sheets PP can be placed on a desired position.

As a mechanism for lowering or lifting the sheet placing unit 20 is configured such that a rack is arranged in the longitudinal beams 11*a*. However, for example, a mechanism in which a worm bar (a bar-shaped screw) is used can be also adapted. Specifically, a worm bar is arranged in the longitudinal beams 11*a*, and the guiding plates 21 are joined with bolts engaged with the worm bar through a supporting member. With this mechanism, it is possible to lift or lower the guiding plates 21, that is, the sheet placing unit 20, by rotating the worm bar. In the case of the configuration, a driving unit to drive the worm bar can be arranged on a side of the mainframe 11. Alternatively, an up-and-down mechanism that uses a chain can be adapted.

An appropriate configuration can be adapted for a frame forming the carriage 10. Likewise, a shape of the guiding plates 21 constituting the sheet placing unit 20 can be also properly changed. An appropriate configuration can be adapted for a driving mechanism of the supporting plate 23.

The sheet supply/convey supporting device 1 can supply sheets not only to a front-loading-type sheet tray/cassette but also to a side-loading-type sheet tray/cassette of an image forming apparatus or the like. Furthermore, the sheet supply/convey supporting device 1 can be effectively used to an optional feeding device such as a feeding tray for a large number of sheets that is provided to a main body of an image forming apparatus.

According to an aspect of the present invention, efforts of supplying sheets can be reduced.

Furthermore, according to another aspect of the present invention, even women or elderly people can easily and reliably supply a heavy sheet stack, and it is possible to reduce a frequency of operations.

Moreover, according to still another aspect of the present invention, even a large number of stacked sheets can be easily supplied.

Furthermore, according to still another aspect of the present invention, it is possible to support sheets with a different size and, even in that case, reliably guide the sheets. In addition, resistance generated when the sheet placing unit is lifted after sheets are supplied can be removed.

Moreover, according to still another aspect of the present invention, it is possible to reliably guide sides of sheets, reduce friction in placing sheets, and remove static electricity between placed sheets.

Furthermore, according to still another aspect of the present invention, the supporting plate can be guided and moved without trouble, particularly, at a time of moving the supporting plate to a closing position.

Moreover, according to still another aspect of the present invention, it is possible to properly position the sheet supply/convey supporting device and to preciously supply sheets to the sheet accommodating unit. This makes it possible to prevent sheets from being improperly supplied.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet supply/convey supporting device used for supplying a sheet stack to a sheet accommodating unit, the sheet supply/convey supporting device comprising:

a sheet placing unit that includes a pair of guide members and a supporting plate and that includes a space for holding a sheet stack, the guide members defining both sides of the space, and the supporting plate defining a bottom of the space to support the sheet stack and being movable between an opened position at which the bottom is opened and a closed position at which the bottom is closed; and a carriage member that supports the sheet placing unit and includes a driving mechanism for lifting or lowering the sheet placing unit, wherein the supporting plate is bendable and slidable along a shape of the guiding members.

2. The sheet supply/convey supporting device according to claim 1, wherein when the sheet placing unit on which the sheet stack is placed is moved over the sheet accommodating unit, the sheet placing unit is lowered into the sheet accommodating unit by the driving mechanism, and the supporting plate is moved to the opened position so that the sheet stack is set in the sheet accommodating unit.

3. The sheet supply/convey supporting device according to claim 1, further comprising a driving mechanism for sliding the supporting plate between the opened position and the closed position.

4. The sheet supply/convey supporting device according to claim 1, wherein a distance between the guiding members is adjustable.

5. The sheet supply/convey supporting device according to claim 1, wherein the guiding members include a plurality of ribs on an inner side thereof that comes into contact with the sheet stack to guide the sheet stack.

6. The sheet supply/convey supporting device according to claim 1, wherein the sheet placing unit includes a coupling guide that couples the guiding members to each other and guide the supporting plate.

7. The sheet supply/convey supporting device according to claim 1, further comprising a positioning unit that comes into contact with the sheet accommodating unit to perform positioning with respect to the sheet accommodating unit.

* * * * *